US010329992B2

(12) United States Patent
Gidla

(10) Patent No.: US 10,329,992 B2
(45) Date of Patent: Jun. 25, 2019

(54) MANIFOLD SEALING FACE FOR IMPROVED BELLOWS INSTALLATION

(71) Applicant: Cummins Inc., Columbus, IN (US)

(72) Inventor: Stephen Sunadh Gidla, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/560,103

(22) PCT Filed: Mar. 24, 2015

(86) PCT No.: PCT/US2015/022245
§ 371 (c)(1),
(2) Date: Sep. 20, 2017

(87) PCT Pub. No.: WO2016/153487
PCT Pub. Date: Sep. 29, 2016

(65) Prior Publication Data
US 2018/0087434 A1 Mar. 29, 2018

(51) Int. Cl.
*F01N 13/10* (2010.01)
*F01N 13/18* (2010.01)

(52) U.S. Cl.
CPC ..... *F01N 13/1827* (2013.01); *F01N 13/10* (2013.01); *F01N 13/1816* (2013.01)

(58) Field of Classification Search
USPC ..... 60/272, 282, 305, 322, 323, 324
See application file for complete search history.

(56) References Cited

U.S. PATENT DOCUMENTS 3,177,649 A * 4/1965 Tromel ..... F01N 13/1811 123/DIG. 1
4,192,143 A * 3/1980 Haegele ..... F01N 13/1811 285/114

(Continued)

FOREIGN PATENT DOCUMENTS

EP 0 491 883 7/1992
EP 0 654 626 5/1995

OTHER PUBLICATIONS

International Search Report from corresponding International Patent Application No. PCT/US2015/022245, dated Jun. 17, 2015, two pages.

(Continued)

*Primary Examiner* — Binh Q Tran
(74) *Attorney, Agent, or Firm* — Foley & Lardner LLP

(57) ABSTRACT

Exhaust manifold assemblies for use in routing exhaust gas from engines are disclosed. An example assembly includes a first manifold section. The first manifold section includes a first body portion defining a first fluid passage. A first annular flange is disposed about a periphery of an end of the first body portion. The first annular flange has a first sealing face and an annular shoulder extending axially outward therefrom. A second manifold section includes a second body portion defining a second fluid passage. A second annular flange is disposed about a periphery of an end of the second body portion. The second annular flange has a second sealing face and a second annular shoulder extending axially outward therefrom. A bellows extends between and fluidly couples the first and second annular flanges and fluidly couples the first and second fluid passages.

30 Claims, 6 Drawing Sheets

(56) References Cited

U.S. PATENT DOCUMENTS

| | | | | |
|---|---|---|---|---|
| 5,159,811 | A * | 11/1992 | Hefler | F01N 13/1811 285/187 |
| 6,032,463 | A * | 3/2000 | Bock | F01N 13/10 285/226 |
| 6,109,661 | A | 8/2000 | Cwik et al. | |
| 6,331,019 | B1 * | 12/2001 | Friess | F01N 13/1811 285/300 |
| 7,284,771 | B2 | 10/2007 | Baumann et al. | |
| 7,712,302 | B2 | 5/2010 | Nichols et al. | |
| 2001/0011824 | A1 | 8/2001 | Davis | |
| 2008/0012296 | A1 | 1/2008 | Johnston et al. | |
| 2015/0059905 | A1 * | 3/2015 | Jones | F16L 23/08 138/109 |

OTHER PUBLICATIONS

Written Opinion from corresponding International Patent Application No. PCT/US2015/022245, dated Jun. 17, 2015, eight pages.

* cited by examiner

MANIFOLD SEALING FACE FOR IMPROVED BELLOWS INSTALLATION

CROSS-REFRENCE TO RELATED APPLICATIONS

This application is a U.S. national stage application claiming the benefit of priority to International Application No. PCT/US2015/022245, filed on Mar. 24, 2015, entitled "Manifold Sealing Face for Improved Bellows Installation," the entire disclosure of which is incorporated herein by reference.

TECHNICAL FIELD

The present disclosure relates generally to the field of exhaust systems for internal combustion engines.

BACKGROUND

Exhaust systems for internal combustion engines include exhaust manifolds connected to cylinder heads of the engine. The exhaust manifolds collect post-combustion material (e.g., exhaust gas) from multiple cylinders of the engine and deliver the material to an exhaust pipe. In operation, exhaust manifolds are subject to highly variable temperatures. Temperature variations cause the exhaust manifolds to expand and contract, which may stress and ultimately damage the manifolds, seals, and other components. Thermal expansion may be particularly problematic for large engines with correspondingly long exhaust manifolds. To that end, exhaust systems for some engines utilize exhaust manifolds that are separated into several sections. The sections are coupled together using a flexible coupling, such as a bellows, that permits expansion and contraction between the sections.

SUMMARY

Various embodiments relate to exhaust manifold assemblies for use in routing exhaust gas from internal combustion engines. An example exhaust system includes a first manifold section, including a first body portion defining a first fluid passage. A first annular flange is disposed about a periphery of an end of the first body portion. The first annular flange has a first sealing face. An annular shoulder extends axially outward from the sealing face. A second manifold section includes a second body portion defining a second fluid passage. A second annular flange is disposed about a periphery of an end of the second body portion. The second annular flange has a second sealing face. A second annular shoulder extends axially outward from the second sealing face. A bellows extends between the first and second annular flanges and fluidly couples the first and second fluid passages. The bellows is removably coupleable to each of the first and second manifold sections.

Various other embodiments relate to a method of installing a bellows into an exhaust manifold assembly for use in routing exhaust gas from an internal combustion engine. The method includes providing the exhaust manifold assembly. The exhaust manifold assembly includes a first manifold section having a first annular flange. A first annular shoulder extends axially outward from the first annular flange. A second manifold section is spaced from the first manifold section. The second manifold section has a second annular flange. A second annular shoulder extends axially outward from the second annular flange. A bellows includes a third annular flange disposed about a periphery of a first end of the bellows. A fourth annular flange is disposed about a periphery of a second end of the bellows. A first gasket is positioned against the first annular flange and a second gasket is positioned against the second annular flange. The method also includes compressing the bellows. Next, the bellows are positioned such that the third annular flange of the bellows contacts the first annular shoulder of the first manifold section, and the fourth annular flange of the bellows contacts the second annular shoulder of the second manifold section. Finally, the bellows are moved along the first and second annular shoulders until the third and fourth annular flanges of the bellows align with the corresponding first and second annular flanges of the respective first and second manifold sections.

Various other embodiments relate to an internal combustion engine system. An example system includes an internal combustion engine and first and second manifold assemblies each in exhaust gas receiving communication with the internal combustion engine. Each of the first and second manifold assemblies includes first and second manifold sections. Each of the first and second manifold sections has a body portion and an annular flange disposed about a periphery of an end of the body portion. An annular shoulder extends axially outward from each annular flange. A bellows fluidly couples the first and second manifold sections.

These and other features, together with the organization and manner of operation thereof, will become apparent from the following detailed description when taken in conjunction with the accompanying drawings, wherein like elements have like numerals throughout the several drawings described below.

DETAILED DESCRIPTION

Figure 1:
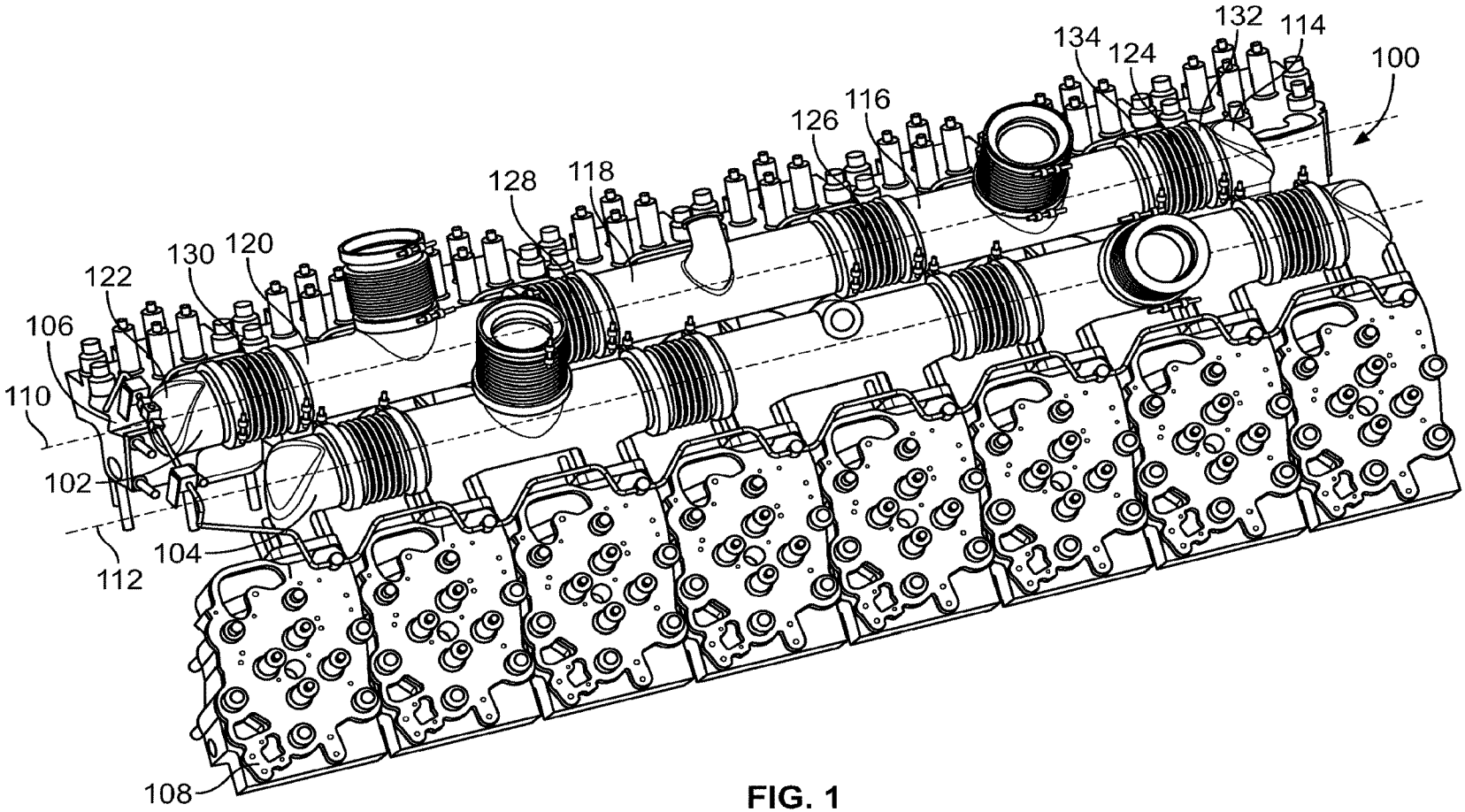
FIG. 1 is a perspective view of a portion of an exhaust system, according to an embodiment.

FIG. 1 is a perspective view of a portion of an exhaust system 100, according to an embodiment. As illustrated in FIG. 1, the exhaust system 100 includes first and second manifold assemblies 102, 104 operably coupled to and in exhaust gas communication with respective first and second cylinder heads 106, 108 of an engine. The first and second manifold assemblies 102, 104 are configured to convey exhaust gas from the respective first and second cylinder heads 106, 108 of the engine. The exhaust gas may be conveyed from the first and second manifold assemblies 102, 104 to various components (e.g., a turbocharger, an exhaust gas recirculation system, exhaust aftertreatment components, etc.) and eventually discharged into the atmosphere. According to various embodiments, the engine may be a compression ignition (e.g., diesel) or spark ignition (e.g., gasoline, compressed natural gas) engine, etc. As illustrated in FIG. 1, the exhaust system 100 is arranged for use with a V-engine. However, the exhaust system 100 may similarly be used with engines having in-line or other cylinder configurations.

As illustrated in FIG. 1, the first and second manifold assemblies 102, 104 extend generally along first and second central axes 110, 112. The first and second central axes 110, 112 may be parallel or substantially parallel with a crankshaft of the engine (not shown). Each of the first and second manifold assemblies 102, 104 includes multiple manifold sections. For example, the first manifold assembly 102 includes, first, second, third, fourth, and fifth manifold sections 114, 116, 118, 120, 122. Each of the first, second, third, fourth, and fifth manifold sections 114, 116, 118, 120, 122 includes a body portion defining a fluid passage extending therethrough. The first manifold assembly 102 also includes several bellows to fluidly couple each of the manifold sections. In particular, a first bellows 124 fluidly couples the fluid passages of the first and second manifold sections 114, 116, a second bellows 126 fluidly couples the fluid passages of the second and third manifold sections 116, 118, a third bellows 128 fluidly couples the fluid passages of the third and fourth manifold sections 118, 120, and a fourth bellows 130 fluidly couples the fluid passages of the fourth and fifth manifold sections 120, 122. Typically, the bellows are compressed between manifold sections and gaskets (not shown) are installed between each manifold section/bellows interface to fluidly seal the interface. The first, second, third, and fourth bellows 124, 126, 128, 130 permit relative displacement, both axially and transversely, between manifold sections. For example, manifold sections may experience relative displacement therebetween due to thermal expansion, vibration, slight assembly misalignments, etc. The bellows permit such displacement, which could otherwise damage conventional, unitary exhaust manifolds.

The manifold sections and bellows may be removably coupled in various ways. In one embodiment, as shown in FIG. 1, v-bands, or "Marman clamps" are utilized to removably couple the manifold sections and bellows, and to compress and retain gaskets therebetween. In other embodiments, flanges of the respective manifold sections and bellows are bolted together. As illustrated in FIG. 1, a first v-band clamp 132 removably couples the first manifold section 114 to a first end of the first bellows 124, a second v-band clamp 134 removably couples a first end of the second manifold section 116 to a second end of the first bellows 124, etc.

Conventionally, manifold assemblies are assembled sequentially from end-to-end or outwards from the center, with gaskets (not shown) compressed between each manifold section/bellows interface. For example, to assemble the first manifold assembly 102, the first manifold section 114 is coupled to the first cylinder head 106, then the first bellows 124 is coupled to the first manifold section 114, then the second manifold section 116 is coupled to each of the first cylinder head 106 and the first bellows 124, etc. Alternatively, the first manifold assembly 102 may be installed from the other end. For example, the fifth manifold section 122 is coupled to the first cylinder head 106, then the fourth bellows 130 is coupled to the fifth manifold section 122, then the fourth manifold section 120 is coupled to each of the first cylinder head 106 and the fourth bellows 130, etc. In another example, the first manifold assembly 102 may be installed outwards from the center. For example, the third manifold section 118 is coupled to the first cylinder head 106; then the second and third bellows 126, 128 are coupled to corresponding ends of the third manifold section 118; then the second manifold section 116 is coupled to each of the first cylinder head 106 and the second bellows 126, and the fourth manifold section 120 is coupled to each of the first cylinder head 106 and the third bellows 128, etc.

Periodically, the exhaust system 100 or portions thereof may need to be removed to service the engine and/or the exhaust system. For example, a cylinder head or gasket may need to be repaired or replaced, or a bellows or manifold gasket may need to be repaired or replaced. However, removing bellows in a service environment may be difficult. One way to remove a bellows is to remove all manifold sections and bellows adjacent one side of the bellows. However, this procedure is labor intensive and time consuming, and may require removal of other adjacent components. Another option is to remove the bellows without removing adjacent manifold sections. However, this is also challenging because the bellows must be compressed in order to be removed and again to be reinstalled. Specialized service tools may be used for this process; however, these tools may be expensive and not all shops may have access to them. Accordingly, providing access to the specialized service tools for every service technician is a significant added cost. Further, different bellows sizes and configurations may require different tools. In addition, if the bellows are removed without removing the adjacent manifold sections, it may be difficult to retain and position the gasket when reinstalling the bellows. For example, the bellows flange may damage or displace the gasket during installation, thereby compromising the sealing capability of the gasket.

According to various embodiments, an exhaust manifold sealing face is provided for improved bellows installation. The manifold section includes a shoulder, or pilot, that extends axially outward from a sealing face of an annular flange of the manifold section. The shoulder is configured to act as a guide for the bellows flange to move (e.g., slide) on as it is being compressed and installed between manifold sections, thereby protecting the gasket from being damaged by the bellows. The shoulder also includes gasket retention features to retain the gasket in position as the bellows is being installed. The shoulder is sized such that the bellows flange does not touch or disrupt the gasket as the bellows is being installed. Although the embodiments described herein include sealing faces for exhaust manifolds, other embodiments include sealing faces of other fluid passages or pipe joints. For example, certain embodiments relate to sealing joints of exhaust pipes downstream of the manifold. In addition, some embodiments include flexible joints or couplings other than bellows.

Figure 2:
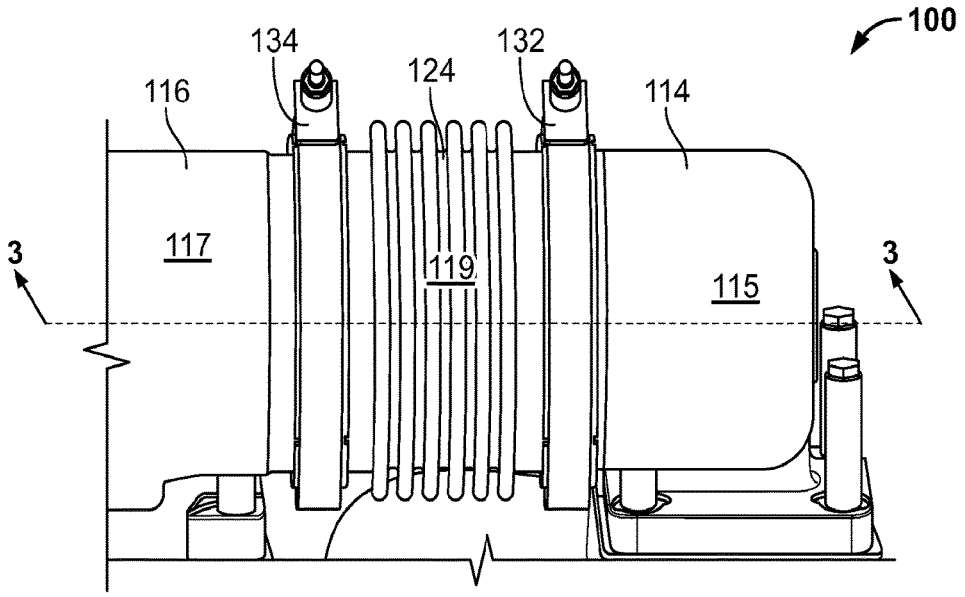
FIG. 2 is a partial side view of the exhaust system of FIG. 1.

FIG. 2 is a partial view of the exhaust system 100 of FIG. 1, including the first and second manifold sections 114, 116; the first bellows 124; and the first and second v-band clamps 132, 134. The first manifold section 114 includes a first body portion 115. The first body portion 115 defines a first fluid passage (not shown) extending therethrough. Similarly, each of the second manifold section 116 and the first bellows 124 include respective second and third body portions 117, 119. The second and third body portions 117, 119 respectively define second and third fluid passages (not shown) extending therethrough.

Figure 3:
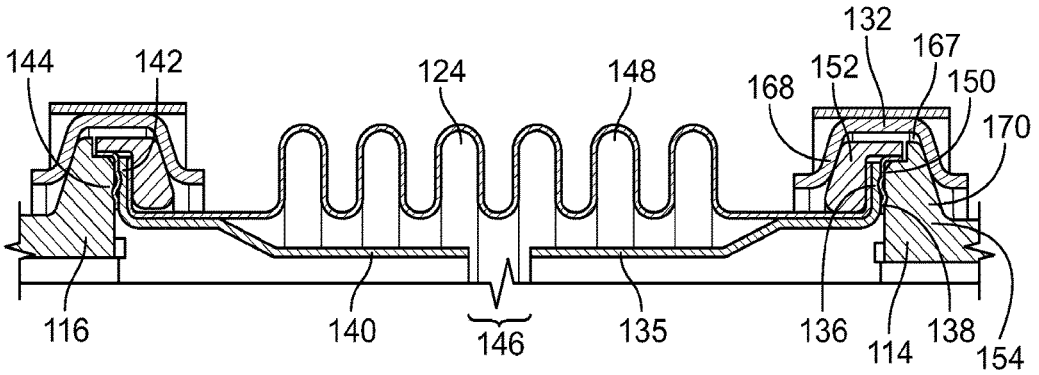
FIG. 3 is a partial cross-sectional view of the exhaust system of FIG. 2, taken along line 3-3.

FIG. 3 is a partial cross-sectional view of the exhaust system 100 of FIG. 2, taken along line 3-3. As shown in FIG.

3, the first bellows 124 fluidly couples the first and second manifold sections 114, 116. The first bellows 124 includes a first sleeve portion 135 that defines a first flange 136 extending radially outward from the first sleeve portion 135 at a first end 138 of the first bellows 124. The first bellows 124 also includes a second sleeve portion 140 that similarly defines a second flange 142 extending radially outward from a second end 144 of the first bellows 124. The first and second sleeve portions 135, 140 are separated by a gap 146. The first and second sleeve portions 135, 140 may be formed of metal (e.g., steel or aluminum), polymer-based, or composite tubing bent or otherwise formed as illustrated in FIG. 3. In some implementations, thermal requirements, for example, may drive material selection. Some embodiments similarly include couplings other than bellows.

The first bellows 124 also includes a flexible member 148 coupling the first and second sleeve portions 135, 140 and disposed on an outer periphery thereof. The flexible member 148 may be fixedly attached (e.g., bonded, adhered, etc.) to the outer periphery of each of the first and second sleeve portions 135, 140. The flexible member 148 may be formed of rubber or other flexible materials. As illustrated in FIG. 3, the flexible member 148 may include a wavy or convoluted surface that facilitates the flexibility of the flexible member 148. For example, the flexible member 148 of the first bellows 124, as well as the gap 146 between the first and second sleeve portions 135, 140, allows the first bellows 124 to expand, contract, and otherwise move axially and transversely due to thermal expansion, vibration, misalignment, etc.

Figure 4:
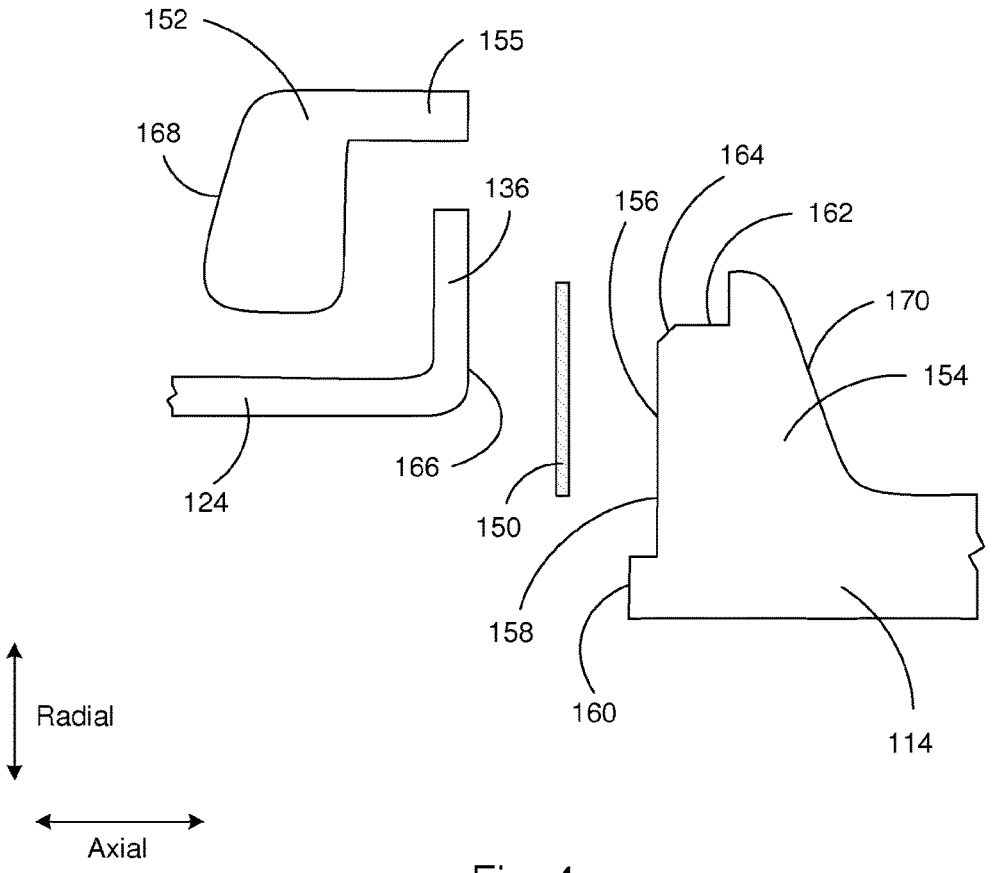
FIG. 4 is a partial exploded cross-sectional view of an interface between the first manifold section and the first bellows of the exhaust system of FIGS. 1-3.

FIG. 4 is a partial exploded cross-sectional view of an interface between the first manifold section 114 and the first bellows 124 of the exhaust system 100 of FIGS. 1-3. In addition to the first manifold section 114 and the first bellows 124, the interface also includes a gasket 150 and a retainer 152 of the first bellows 124. It is important to note that only a portion of the interface is shown in FIG. 4. It should be understood that each of the first manifold section 114, the first bellows 124, the gasket 150, and the retainer 152 extend annularly about the first central axis 110 (FIG. 1). However, the first manifold section 114 and the first bellows 124 need not extend annularly about the first central axis 110 (FIG. 1) for their entire length. Instead, any of the manifold sections and bellows, including the first manifold section 114 and the first bellows 124, may include bends or curves.

The first manifold section 114 includes an annular flange 154 disposed about and extending radially outwardly from a periphery of a first end 156 of the first manifold section 114. The annular flange 154 defines a sealing face 158. The first manifold section 114 also includes an annular shoulder 160 that extends axially outward from the sealing face 158. The annular shoulder 160 is positioned radially inward of the sealing face 158. The annular flange 154 also defines a notch 162 extending axially inward from the sealing face 158 at a radially outward-most portion of the annular flange 154. A chamfered edge 164 extends between the sealing face 158 and the notch 162.

The first flange 136 of the first bellows 124 defines a sealing face 166. In operation, the gasket 150 is sandwiched between the sealing face 158 of the first manifold section 114 and the sealing face 166 of the first bellows 124 to provide a fluid seal therebetween. For example, the retainer 152 is configured to engage the first flange 136 of the first bellows 124 to compress the gasket 150 between the sealing faces 158, 166 of the first manifold section 114 and the first bellows 124. The gasket 150 may be formed from any of several materials, such as graphite, rubber, silicone, polymers, etc. In some implementations, the gasket 150 is deformable, compressible, and/or resilient. The retainer 152 also includes a lip 165 that extends into the notch 162 of the annular flange 154.

Returning briefly to FIG. 3, the first v-band clamp 132 includes an inner surface 167 configured to engage each of an outer clamping surface 168 of the retainer 152 and an outer clamping surface 170 of the annular flange 154 of the first manifold section 114. Upon installation, the v-band clamp forces the first flange 136 of the first bellows 124 towards the annular flange 154 of the first manifold section 114 to compress the gasket 150 between the corresponding sealing faces 158, 166 of the respective flanges 136, 154.

Figure 5:
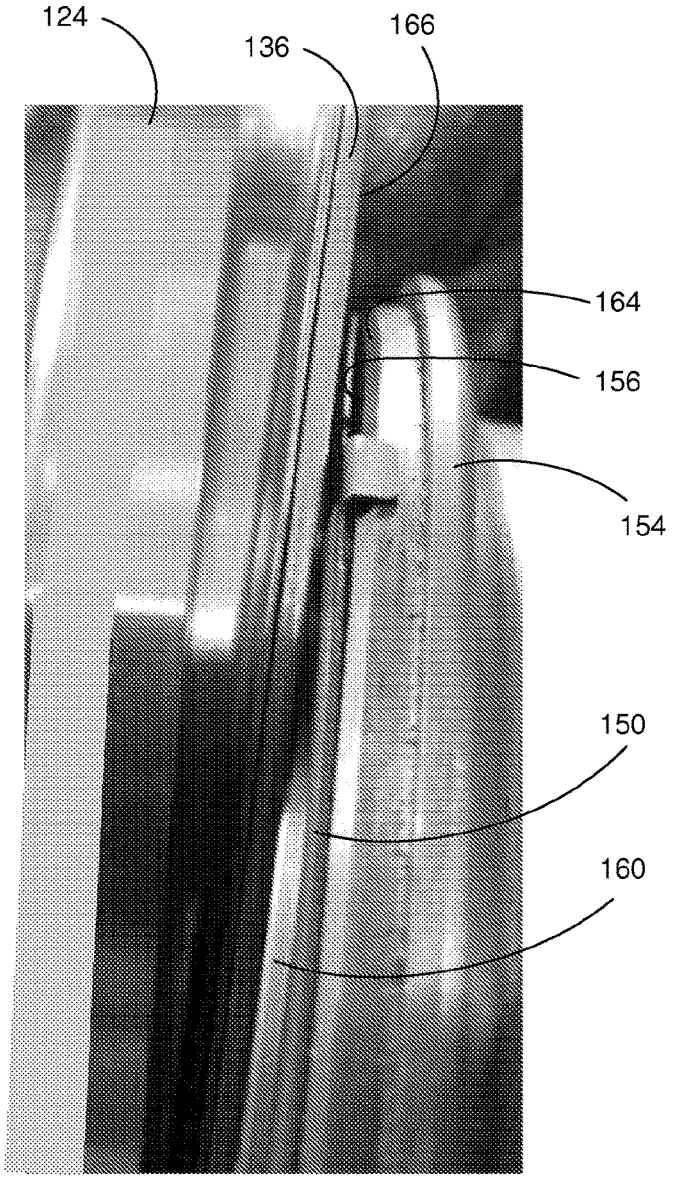
FIG. 5 illustrates the first bellows being coupled to the first manifold section of the exhaust system of FIGS. 1-4.

Turning to FIG. 5, the first bellows 124 being coupled to the first manifold section 114 is illustrated. In order to install the first bellows 124 between the first and second manifold sections 114, 116, the first bellows 124 is compressed and the sealing face 166 of the first bellows 124 is positioned against the annular shoulder 160 of the first manifold section 114. The annular shoulder 160 is configured to operate as a pilot, or guide, to prevent the first flange 136 of the first bellows 124 from touching and/or damaging the gasket 150 as the first bellows 124 is being coupled to the first manifold section 114. The annular shoulder 160 extends axially outward from the sealing face 158 of the first manifold section 114 by a first length. The first length of the annular shoulder 160 is sized to provide a clearance between the first flange 136 of the first bellows 124 and the gasket 150. In one embodiment, the first length is at least twice the thickness of the gasket 150. In another embodiment, the first length is at least three times the thickness of the gasket 150. In some embodiments, the first length is further dependent on a diameter of the first bellows 124. The first length may also be dependent on a size of the sealing face 158 and/or a width of the gasket 150, among other factors. The annular shoulder 160 may include a radius or chamfer to help guide the first flange 136 of the first bellows 124 onto the annular shoulder 160.

Figure 6:
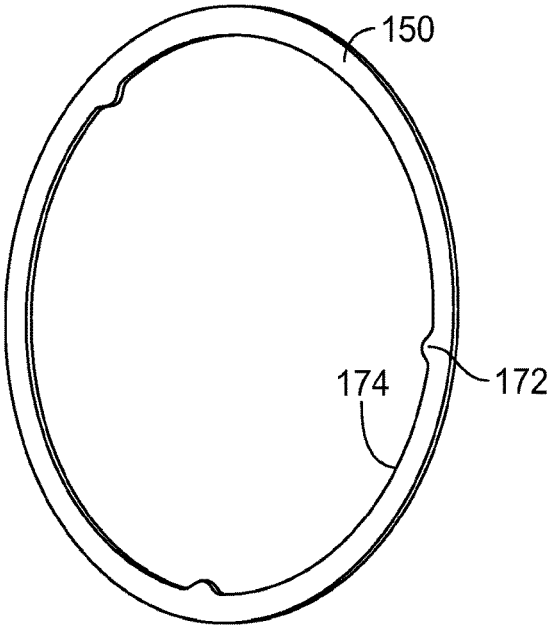
FIG. 6 is a perspective view of the gasket of FIGS. 3-5.

FIG. 6 is a perspective side view of the gasket 150 of FIGS. 3-5. As shown in FIG. 6, in some embodiments, the gasket 150 includes one or more retention ribs 172 extending radially inward from an inner radial face 174 of the gasket 150.

Figure 7:
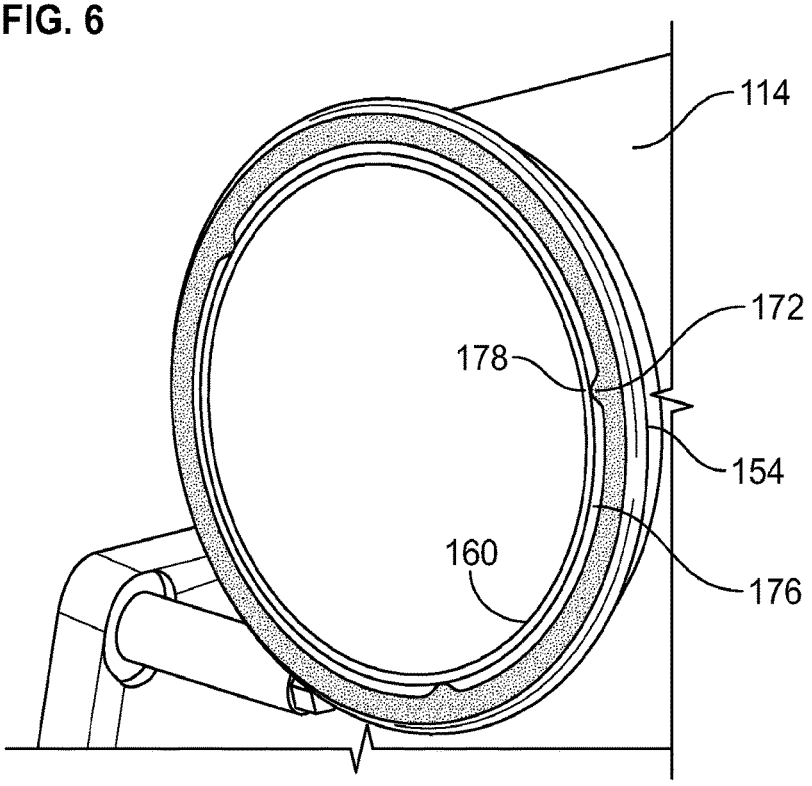
FIG. 7 is a perspective view of the gasket of FIGS. 3-6 positioned against the annular flange of the first manifold section.

FIG. 7 is a perspective view of the gasket 150 of FIGS. 3-6 positioned against the annular flange 154 of the first manifold section 114. As illustrated in FIG. 7, according to an embodiment, the annular shoulder includes an outer radial face 176 defining retention features 178 extending radially inward from the outer radial face 176. The retention features 178 are sized, shaped, and positioned to accept the retention ribs 172 of the gasket 150. The interface between the retention ribs 172 and the retention features 178 operates to retain the gasket 150 against the annular flange 154 of the first manifold section 114 as the first bellows 124 is being coupled to the first manifold section 114. In some embodiments, the retention features 178 include dimples positioned about the outer radial face 176. In other embodiments, the retention features 178 include a notch extending radially inward from the outer radial face 176. The dimples may operate to restrict the rotational position of the gasket 150, while the notch may allow rotation of the gasket 150. In some embodiments, the gasket 150 has an inner diameter that is equal to or slightly smaller than an outer diameter of the annular shoulder 160 such that an interference fit between the gasket 150 and the annular shoulder 160 further operates to retain the gasket 150 against the annular flange 154 of the first manifold section 114. Accordingly, the annular flange 154 and the gasket 150 overcome problems associated with conventional exhaust bellows systems related to gaskets becoming misaligned or misplaced during bellows installation.

Figure 8:
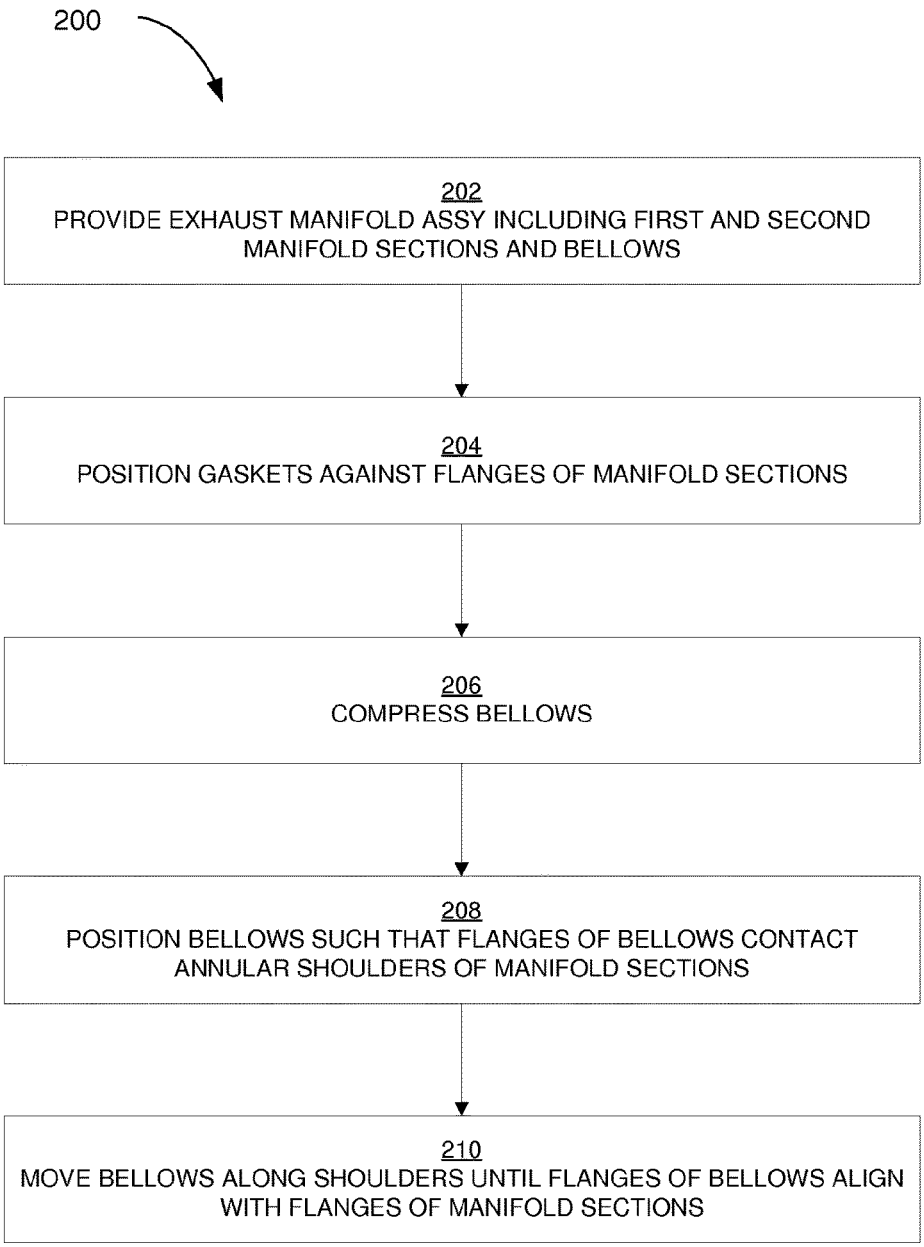
FIG. 8 is a flow diagram of a method of installing bellows between exhaust manifold sections, according to an embodiment.

FIG. 8 is a flow diagram of a method 200 of installing bellows between exhaust manifold sections, according to an embodiment. For example, the method 200 may be performed to install the first bellows 124 between the first and second manifold sections 114, 116. However, the method 200 is not limited to this embodiment and may similarly be performed using other components.

At 202, an exhaust system is provided. The exhaust system includes first and second manifold sections and a bellows. In an embodiment, the first manifold section includes a first annular flange and a first annular shoulder extending axially outward from the first annular flange. The second manifold section is spaced from the first manifold section. The second manifold section includes a second annular flange and a second annular shoulder extending axially outward from the second annular flange. The bellows includes third and fourth annular flanges. The third annular flange is disposed about a periphery of a first end of the bellows. The fourth annular flange is disposed about a periphery of a second end of the bellows.

At 204, gaskets are positioned against the first and second annular flanges. More specifically, a first gasket is positioned against the first annular flange and a second gasket is positioned against the second annular flange. Each of the first and second gaskets may be positioned against sealing faces of the respective first and second annular flanges.

At 206, the bellows is compressed. Because the bellows is flexible, the bellows can be compressed by forcing the first and second ends of the bellows towards each other.

At 208, the bellows is positioned such that the third annular flange of the bellows contacts the first annular shoulder of the first manifold section, and the fourth annular flange of the bellows contacts the second annular shoulder of the second manifold section.

At 210, the bellows is moved (e.g., slid) along the first and second annular shoulders until the third and fourth annular flanges of the bellows align with the corresponding first and second annular flanges of the respective first and second manifold sections. The first and second annular shoulders are sized to provide clearances between the third and fourth annular flanges of the bellows and the first and second gaskets. Accordingly, the first and second annular shoulders protect the first and second gaskets from being damaged as the bellows is installed.

Once the bellows is positioned and aligned between the first and second manifold sections, v-band clamps may be installed to retain the bellows in place. For example, regarding the first manifold section, a retainer is positioned against an outer surface of the third annular flange of the bellows. A v-band clamp is positioned over each of the first annular flange of the first manifold section and the retainer. Finally, the v-band clamp is tightened to compress the gasket between the first annular flange and the third annular flange. The bellows can be removed by reversing the method 200 described above.

While this specification contains many specific implementation details, these should not be construed as limitations on the scope of what may be claimed, but rather as descriptions of features specific to particular implementations. Certain features described in this specification in the context of separate implementations or embodiments can also be implemented in combination in a single implementation or embodiment as would be understood by one of ordinary skill in the art. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. It should be understood that features described in one embodiment could also be incorporated and/or combined with features from another embodiment in manner understood by those of ordinary skill in the art. It should also be noted that the terms "example" and "exemplary" as used herein to describe various embodiments are intended to indicate that such embodiments are possible examples, representations, and/or illustrations of possible embodiments (and such terms are not intended to connote that such embodiments are necessarily extraordinary or superlative examples).

What is claimed is:

1. An exhaust manifold assembly for use in routing exhaust gas from an internal combustion engine, the exhaust manifold assembly comprising:

a first manifold section, including:

a first body portion defining a first fluid passage, a first annular flange disposed about a periphery of an end of the first body portion, the first annular flange having a first sealing face, and a first annular shoulder extending axially outward from the first sealing face;

a second manifold section, including:

a second body portion defining a second fluid passage, a second annular flange disposed about a periphery of an end of the second body portion, the second annular flange having a second sealing face, and a second annular shoulder extending axially outward from the second sealing face; and a bellows extending between the first annular flange and the second annular flange, the bellows fluidly coupling the first and second fluid passages, the bellows being removably coupleable to each of the first and second manifold sections.

2. The exhaust manifold assembly of claim 1, wherein the first annular shoulder is positioned radially inward of the first sealing face.

3. The exhaust manifold assembly of claim 1, further comprising:

a first gasket positioned adjacent the first sealing face, the first annular shoulder extending from the first sealing face by a first length, the first length of the first annular shoulder being longer than a thickness of the first gasket; and a second gasket positioned adjacent the second sealing face, the second annular shoulder extending from the second sealing face by a second length, the second length of the second annular shoulder being longer than a thickness of the second gasket.

4. The exhaust manifold assembly of claim 3, wherein the first length of the first annular shoulder is at least twice the thickness of the first gasket, and wherein the second length of the second annular shoulder is at least twice the thickness of the second gasket.

5. The exhaust manifold assembly of claim 3, wherein the first annular shoulder includes a first outer radial face defining gasket retention features extending radially inward from the first outer radial face, and wherein the second annular Shoulder includes a second outer radial face defining gasket retention features extending radially inward from the second outer radial face.

6. The exhaust manifold assembly of claim 5, wherein the first gasket includes first retention ribs extending radially inward from an inner radial face of the first gasket, the first retention ribs sized and positioned to fit into the gasket retention features, and wherein the second gasket includes second retention ribs extending radially inward from an inner radial face of the second gasket, the second retention ribs sized and positioned to fit into the gasket retention features.

7. The exhaust manifold assembly of claim 3, wherein the bellows includes:

a third body portion defining a third fluid passage;

a third annular flange disposed about a periphery of a first end of the third body portion, the third annular flange of the bellows having a third sealing face; and a fourth annular flange disposed about a periphery of a second end of the third body portion, the fourth annular flange of the bellows having a fourth sealing face.

8. The exhaust manifold assembly of claim 7, wherein, in an assembled state, the first gasket is sandwiched between the first sealing face of the first manifold section and the third sealing face of the bellows, and the second gasket is sandwiched between the second sealing face of the second manifold section and the fourth sealing face of the bellows.

9. The exhaust manifold assembly of claim 7, wherein the first annular shoulder of the first manifold section is sized to provide a clearance between the third annular flange of the bellows and the first gasket when the bellows is being coupled to the first manifold section, and wherein the second annular shoulder of the second manifold section is sized to provide a clearance between the fourth annular flange of the bellows and the second gasket when the bellows is being coupled to the second manifold section.

10. The exhaust manifold assembly of claim 7, further comprising:

a retainer having a first outer clamping surface; and a v-band clamp having an inner clamping surface configured to engage each of the first outer clamping surface of the retainer and a second outer clamping surface of the first annular flange of the first manifold section.

11. The exhaust manifold assembly of claim 10, wherein the retainer has an inner engagement surface abutting the third annular flange of the bellows, wherein the v-band clamp is configured to force the third annular flange of the bellows towards the first annular flange of the first manifold section to compress the first gasket between the first and third sealing faces.

12. The exhaust manifold assembly of claim 1, wherein the end of the second body portion of the second manifold section is a first end, and wherein the second manifold section further includes:

a second end opposite the first end;

a fifth annular flange disposed about a periphery of the second end of the second body portion, the fifth annular flange having a fifth sealing face; and a third annular shoulder extending axially outward from the fifth sealing face.

13. The exhaust manifold assembly of claim 12, wherein the bellows is a first bellows, and further comprising:

a third manifold section, including:

a fourth body portion defining a fourth fluid passage, a sixth annular flange disposed about a periphery of an end of the fourth body portion, the sixth annular flange having a sixth sealing face, and a fourth annular shoulder extending axially outward from the sixth sealing face; and a second bellows extending between the fifth and sixth annular flanges and fluidly coupling the second and fourth fluid passages, the second bellows being removably coupleable to each of the second and third manifold sections.

14. A method of installing a bellows into an exhaust manifold assembly for use in routing exhaust gas from an internal combustion engine, the method comprising:

providing the exhaust manifold assembly, the exhaust manifold assembly including:

a first manifold section having a first annular flange and a first annular shoulder extending axially outward from the first annular flange, a second manifold section spaced from the first manifold section, the second manifold section having a second annular flange and a second annular shoulder extending axially outward from the second annular flange, and a bellows including:

a third annular flange disposed about a periphery of a first end of the bellows, and a fourth annular flange disposed about a periphery of a second end of the bellows;

positioning a first gasket against the first annular flange and a second gasket against the second annular flange;

compressing the bellows;

positioning the bellows such that the third annular flange of the bellows contacts the first annular shoulder of the first manifold section, and the fourth annular flange of the bellows contacts the second annular shoulder of the second manifold section; and moving the bellows along the first and second annular shoulders until the third and fourth annular flanges of the bellows align with the corresponding first and second annular flanges of the respective first and second manifold sections.

15. The method of claim 14, wherein the first annular shoulder is sized to provide a clearance between the third annular flange of the bellows and the first gasket, and the second annular shoulder is sized to provide a clearance between the fourth annular flange of the bellows and the second gasket when the bellows is being moved along the first and second annular shoulders.

16. The method of claim 14, wherein the first annular flange defines a first sealing face, the second annular flange defines a second sealing face, the third annular flange defines a third sealing face, and the fourth annular flange defines a fourth sealing face, and wherein the first gasket is positioned between the first and third sealing faces and the second gasket is positioned between the second and fourth sealing faces.

17. The method of claim 16, wherein the first annular shoulder is positioned radially inward from the first sealing face and the second annular shoulder is positioned radially inward from the second sealing face.

18. The method of claim 16, further comprising aligning retention ribs of the first and second gaskets with corresponding retention features of the respective first and second annular shoulders, such that the first and second gaskets are retained against the respective first and second sealing faces prior to positioning the bellows.

19. The method of claim 14, further comprising:

positioning a retainer against an outer surface of the third annular flange of the bellows;

positioning a v-band clamp over each of the first annular flange of the first manifold section and the retainer; and tightening the v-band clamp to compress the gasket between the first annular flange and the third annular flange.

20. An internal combustion engine system, comprising:

an internal combustion engine; and first and second manifold assemblies each in exhaust gas receiving communication with the internal combustion engine, each of the first and second manifold assemblies including:

first and second manifold sections, each of the first and second manifold sections having a body portion and an annular flange disposed about a periphery of an end of the body portion, and an annular shoulder extending axially outward from each annular flange, and a bellows fluidly coupling the first and second manifold sections.

21. The system of claim 20, wherein the annular flanges of each of the first and second manifold sections of each of the first and second manifold assemblies further include sealing faces.

22. The system of claim 21, wherein each of the first and second manifold assemblies further includes gaskets positioned adjacent the sealing faces of each of the first and second manifold sections, and wherein the annular shoulders of each of the first and second manifold assemblies extend from the sealing faces by a length, the length of each of the annular shoulders of each of the first and second manifold assemblies being longer than a thickness of one of the gaskets.

23. The system of claim 22, wherein the length of each of the annular shoulders of each of the first and second manifold assemblies is at least twice the thickness of one of the gaskets.

24. The system of claim 22, wherein each of the annular shoulders of each of the first and second manifold assemblies includes an outer radial face defining gasket retention features extending radially inward from the outer radial face.

25. The system of claim 24, wherein each of the gaskets of each of the first and second manifold assemblies includes retention ribs extending radially inward from an inner radial face of the respective gaskets, the retention ribs sized and positioned to fit into the gasket retention features.

26. The system of claim 22, wherein the bellows of each of the first and second manifold assemblies includes a body portion and annular flanges disposed about a periphery of respective ends of the respective body portion, each of the annular flanges the bellows of each of the first and second manifold assemblies having a sealing face.

27. The system of claim 26, wherein, in an assembled state, one of the gaskets of each of the first and second manifold assemblies is sandwiched between respective sealing faces of the respective first manifold section and the respective bellows, and the other of the gaskets of each of the first and second manifold assemblies is sandwiched between respective sealing faces of the respective second manifold section and the respective bellows.

28. The system of claim 26, wherein the annular shoulders of each of the first and second manifold assemblies are sized to provide clearances between the respective annular flanges of the respective bellows and the respective gaskets when the respective bellows is being coupled to the respective first and second manifold sections.

29. The system of claim 20, wherein the bellows are first bellows, and wherein each of the first and second manifold assemblies further includes:

a fifth manifold section; and a second bellows fluidly coupling the respective second and fifth manifold sections.

30. The system of claim 20, wherein at least one of the first and second manifold assemblies includes at least four manifold sections and at least three bellows fluidly coupling the at least four manifold sections.

* * * * *